United States Patent [19]

Warsop

[11] 4,306,429

[45] Dec. 22, 1981

[54] NOVEL STITCH BONDED FABRICS

[76] Inventor: David H. Warsop, 15 Meins Croft, Blackburn, Lancashire, England

[21] Appl. No.: 103,374

[22] Filed: Dec. 13, 1979

[30] Foreign Application Priority Data

Dec. 14, 1978 [GB] United Kingdom ..... 48614/78

[51] Int. Cl.[3] ..... D04B 23/08; D04B 23/10

[52] U.S. Cl. ..... 66/193; 66/190; 66/192

[58] Field of Search ..... 66/170, 171, 190, 192, 66/195, 193

[56] References Cited

U.S. PATENT DOCUMENTS

| | | | |
|---|---|---|---|
| 3,664,157 | 5/1972 | Kochta et al. | 66/190 |
| 3,718,011 | 2/1973 | Peschl et al. | 66/192 |
| 3,782,137 | 1/1974 | Hughes | 66/192 |
| 3,992,902 | 11/1976 | Webb et al. | 66/192 |

*Primary Examiner*—Ronald Feldbaum

*Attorney, Agent, or Firm*—Oblon, Fisher, Spivak, McClelland & Maier

[57] ABSTRACT

Novel stitch bonded fleece fabrics are made on two bar machines with the front bar knitting pillar stitch and the back bar, with incomplete e.g. half set threading, traversing adjacent wales of the front bar, the tension of the back bar threads in relation to that of the front bar threads being such as to pull adjacent wales of the pillar stitches together. The back bar threads are alternately knitted and laid in, which results in large and small loops causing the fleece fibers to bunch into weftway fiber bundles. The combination of wales pulled together and the weft effect can simulate the appearance of a leno weave fabric.

12 Claims, 7 Drawing Figures

NOVEL STITCH BONDED FABRICS

This invention relates to novel stitch bonded fleece fabrics.

Stitch bonded fleece fabric is made by stitching a fibre fleece, usually a cross-folded card web, with rows (or wales) of warp thread stitches. Most such fabric is made on single guide bar machines such as the Arachne and Maliwatt machines, though a proportion is made on two guide bar machines.

The basic fabric is uninteresting as regards its appearance. Scope exists, on single bar machines, only to bring about a rib effect by missing out occasional warp threads. A common form of two bar fabric is made with pillar stitches on the front bar and tricot stitches on the back bar.

There have been proposals for adding lengthwise and transverse ribs (to result in a check effect) to two bar fabrics by missed thread patterning on the back bar, with an occasional traverse of the back bar thread structure over three or even more wales of the front bar pillar stitch structure.

None of these measures disguises the fact that the fabric is based on a fibre fleece. The fabric is suitable for a number of end uses, for example as printed curtains, bedspreads, tickings and so on, but it is usually regarded as a relatively coarse fabric of inferior quality when compared with conventional woven or knitted fabrics, of commercial interest only because, containing mostly fibres and very little yarn, it is relatively inexpensive.

The present invention, however, provides a stitch bonded fabric that much more closely resembles fabric made of warp and weft yarn, rather than warp yarn with a fibre filling.

The invention comprises a stitch bonded fleece fabric comprising fibres bonded by front and back bar structures of warp threads, characterised in that the front bar structure comprises pillar stitch chains and the back bar structure has incomplete threading and extends over adjacent wales of the front bar structure, the tension of the back bar thread being such as to pull adjacent wales of pillar stitches together.

The second bar structure may comprise stitches and laid-in sections of thread, or stitches laid-in sections and floats of thread. It may comprise stitches along only one of the said adjacent wales, and in general may comprise fewer stitches than courses. For example, it may comprise one stitch every three courses, or one stitch every other course, or two stitches every three courses.

Due to the tension in the back bar threads, those stitch loops that contain both front and back bar threads are small and tight, whereas loops that contain front bar threads only are longer and not so tight. The fleece fibres are pulled into compact, well-defined bundles by the tight loops, and into looser, less compact bundles by the longer loops. The bundles, especially the compact bundles, closely resemble weft threads in a weave. Different back bar pattern notations give different spacings and ordering of spacings between the weftway bundles, giving the effect of different kinds of weave.

Back bar tension also pulls in the adjacent wales of pillar stitches so that they are actually touching each other. The effect of this can be to simulate a leno weave.

The overall result, depending on the precise configuration of the back bar stitches, will resemble a weft-insertion fabric or even a Leno weave fabric.

Examples of stitch bonded fleece fabrics according to the invention will now be described with reference to the accompanying drawings, in which:

FIG. 1 is a point diagram for the front bar thread structure common to all the examples, FIG. 2 is a point diagram for the back bar thread structure of a first example, FIG. 3 is a point diagram of the back bar structure for a second example, FIG. 4 is a point diagram of the back bar structure for a third example, FIG. 5 is a diagrammatic illustration of the appearance of the fabric of the first example, FIG. 6 is a like illustration of the second example, and FIG. 7 is a like illustration for the third example.

FIG. 1 illustrates the standard pillar stitch that is the conventional basis of single bar stitch bonded fabrics. However, whereas, in such conventional fabrics, and even in conventional two bar fabrics, the stitches manifest themselves in the fabric (both before and after finishing) as equally spaced parallel rows (wales) of stitches, according to the present invention, the front bar wales are pulled together into pairs (or, it might be, threes) to make a distinctively different kind of fabric.

The back bar thread structures illustrated in FIGS. 2, 3 and 4 have this in common, that they extend over adjacent wales of the front bar stitches. The pulling together of the front bar wales into pairs is effected by suitable adjustment of the tension of the back bar threads.

On most machines, tension is adjusted by first setting the run-in of the thread to a predetermined figure, and then making minor adjustments to the let-off mechanism until the machine is knitting properly. Where a run-in figure is quoted below, it is to be recognised that this is a nominal figure for setting-up purposes, and that minor adjustments may have to be made.

Example I, illustrated by FIGS. 2 and 5, has a back bar structure comprising stitches 21, laid in sections 22 of thread, and thread floats 23. There are fewer stitches than courses, with a stitch 21 only every third course. In conventional warp knitting notation, the back bar structure is 0-, 2-2, 2-2. The back bar threading is "1 miss 1", that is to say, there is a back bar thread only every other wale. In this fabric, the run-in on the front bar is 97" (246 cm)—that is to say, 97" of thread is fed in, via a positive feed let-off motion on the beam, every rack or 480 courses. The back bar run-in, however, is only 38" (97 cm).

For convenience, we can say that the specification of this fabric is B (1 miss 1; 0-1, 2-2, 2-2; 38) F (full set; 1-0, 0-1; 97). "B" denotes back, "F" denotes front bar set up. The first item in the bracket is the nature of the threading, the second item is the conventional notation for the motion of the bar in the knitting cycle, while the third item is the run-in in inches (as is conventional).

The yarn tensions during the knitting cycle and the chosen pattern notation for the back bar give rise to pronounced warp and weft effects in the fabrics, as can be seen from FIGS. 5, 6 and 7.

The back bar threads, in the first place, pull togeher the adjacent pillar stitch wales that they connect until they are touching. Then, when a stitch is formed by both the back bar and the front bar, the back bar tension pulls it into a tight, small stitch, as shown at 24. Whereas stitches formed only by the front bar are longer and not so tight. Some fleece fibre bundles, for example those at 25, that pass through the small stitches, are well defined and compact, whereas the bundles 26 that pass through the longer stitches 27 are not so compact. The fibre bundles in this way are made to resemble weft threads in a woven fabric.

The resulting fabric—especially after heat setting which can cause some contraction of the stitching threads—resembles a weft insertion fabric or a Leno weave fabric.

Figure 1:
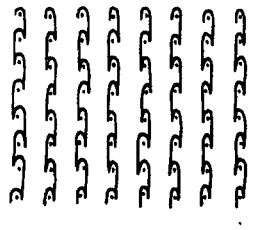
Figure 2:
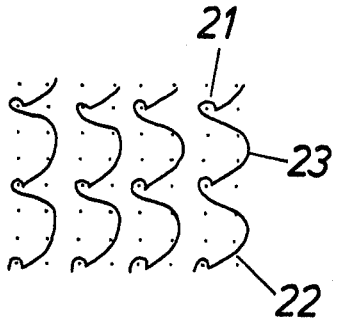
FIGS. 2 and 6 illustrate another fabric, Example II, for which the specification is B (1 miss 1; 0-1, 2-2; 49) F (full set; 1-0, 0-1; 103). The back bar stitches every other course, in this Example.
Figure 3:
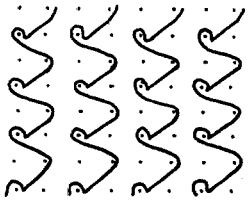
FIGS. 3 and 7 illustrate another fabric, Example III, for which the specification is B (1 miss 1; 0-1, 1-0, 2-2; 64) F (full set; 1-0, 0-1; 98). In this case there are two back bar stitches every three courses.
Figure 4:
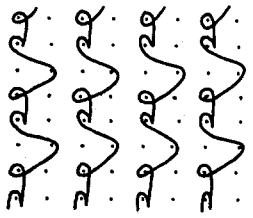
Figure 5:
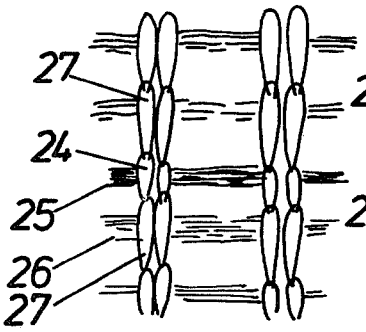
Figure 6:
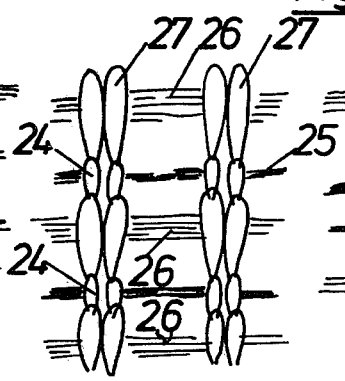
Figure 7:
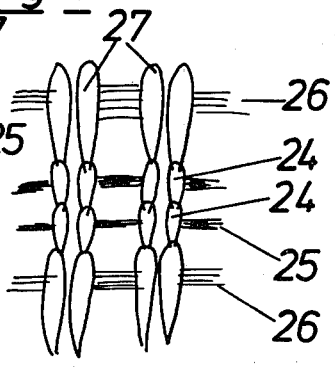

In each case, the back bar stitches of each thread have been confined to a single wale. This is not mandatory—special effects could be produced by arranging that sometimes the stitches are in one wale, and sometimes on the adjacent wale.

Each back bar thread has, in the Examples, been shown connecting an adjacent pair of front bar threads. Other effects could also, however, be produced by connecting a front bar wale with the one on its right hand side for a certain number of courses, then with the one on its left hand side for a certain number (perhaps, but not necessarily, an equal number) of courses.

Other variations might be made by such measures as (a) using missed thread patterning on the front bar, and/or (b) pulling three adjacent front bar wales together with one or two adjacent back bar threads.

Though the terms "front" and "back bar" have been used, it is to be understood that the invention can also be carried out on machines having more than two guide bars.

What we claim is:

1. A stitch bonded fleece fabric comprising fibres bonded by front and back bar structures of warp threads wherein the front bar structure comprises pillar stitch chains and said back bar structure comprises part set threading and extends over at least two adjacent wales of the front bar structure, the tension of the back bar thread being such, in relation to that of the front bar thread, as to pull said at least two adjacent wales of said pillar stitches together.

2. A stitch bonded fleece fabric according to claim 1, wherein said back bar structure comprises stitches and laid in sections of thread.

3. A stitch bonded fleece fabric according to claim 1, wherein said back bar structure comprises stitches and laid in sections and floats of thread.

4. A stitch bonded fleece fabric according to claim 1, wherein said back bar structure comprises stitches along one only of the said adjacent wales.

5. A stitch bonded fleece fabric according to claim 1, wherein said back bar structure comprises fewer stitches than courses.

6. A stitch bonded fleece fabric according to claim 5, wherein said back bar structure comprises one stitch every three courses.

7. A stitch bonded fleece fabric according to claim 5, wherein said back bar structure comprises one stitch every other course.

8. A stitch bonded fleece fabric according to claim 5, wherein said back bar structure comprises two stitches every three courses.

9. A stitch bonded fleece fabric according to claim 1 wherein some courses the back bar threads do not form stitches, and the stitches that are formed from both front and back bar threads are shorter than the stitches that are formed from front bar threads only.

10. A stitch bonded fleece fabric according to claim 1 wherein said back bar is threaded 1-in, 1-out, and the lapping movement is 0-1, 1-0, 2-2; with a run in of 64 while said front bar is Full set; and the lapping movement is 1-0, 0-1; with a run in of 98.

11. A stitch bonded fleece fabric according to claim 1 wherein said back bar is threaded 1-in, 1-out, and the lapping movement is 0-1, 2-2; with a run in of 49 while said front bar is full set; and the lapping movement is 1-0, 0-1; with a run in of 103.

12. A stitch bonded fleece fabric according to claim 1 wherein said back bar is threaded 1-in, 1-out, and the lapping movement is 0-1, 2-2, 2-2; with a run in of 38 while said front bar is full set; and the lapping movement is 1-0, 0-1; with a run in of 97.

* * * * *